United States Patent [19]

Mecadon

[11] Patent Number: 4,942,625

[45] Date of Patent: Jul. 24, 1990

[54] SLIP

[76] Inventor: Linda Mecadon, 3432 San Juan Canyon Rd., San Juan Bautista, Calif. 95054

[21] Appl. No.: 272,580

[22] Filed: Nov. 17, 1988

[51] Int. Cl.[5] ..... A41B 9/00

[52] U.S. Cl. ..... 2/73; 2/71; 2/109; 2/211

[58] Field of Search ..... 2/71, 72, 73, 109, 113, 2/114, 211, 212; 450/5, 7, 11; D2/19, 20, 21

[56] References Cited

U.S. PATENT DOCUMENTS

| | | | |
|---|---|---|---|
| 1,037,514 | 9/1912 | O'Connor et al. | 2/211 |
| 1,470,849 | 10/1923 | Klappert | 2/72 |
| 2,080,814 | 5/1937 | Foltz | 2/72 |
| 2,308,337 | 1/1943 | McDonald | 2/113 |
| 2,308,339 | 1/1943 | Mendenhall | 2/113 |
| 2,358,113 | 9/1944 | Solomon | 2/212 |
| 2,724,120 | 11/1955 | Biern | 2/73 X |
| 2,805,422 | 9/1957 | Rickert | 2/73 |
| 3,066,308 | 12/1962 | Erteszek | 2/71 X |
| 3,164,843 | 1/1965 | Erteszek | 2/212 |
| 3,323,139 | 6/1967 | Champagne et al. | 2/73 X |
| 4,247,959 | 2/1981 | Rose | 2/212 |
| 4,790,032 | 12/1988 | Girouard | 2/109 |

FOREIGN PATENT DOCUMENTS

| | | | |
|---|---|---|---|
| 426543 | 4/1935 | Fed. Rep. of Germany | 2/212 |
| 1075443 | 10/1954 | France | 2/72 |
| 1142056 | 2/1969 | United Kingdom | 2/73 |

*Primary Examiner*—Werner H. Schroeder
*Assistant Examiner*—Jeanette E. Chapman
*Attorney, Agent, or Firm*—Townsend and Townsend

[57] ABSTRACT

An improved slip to be worn as an undergarment beneath a dress or skirt of the type having a side, front or back slit in the lower edge of a dress or skirt. The slip can either be a half-slip or full slip. It is provided with an opening or recess in a panel of the slip, such as at the rear or front of the slip. The opening is of sufficient size to be larger than the slit in the dress or skirt with which the slip is used. The panel with the opening is opposite to a full panel, such as at the front or rear of the slip so that the full panel alone serves to block the light tending to pass through the dress or skirt and slip. With this one full panel, there is no need to have a conventional slip encompassing the legs of the wearer.

14 Claims, 3 Drawing Sheets

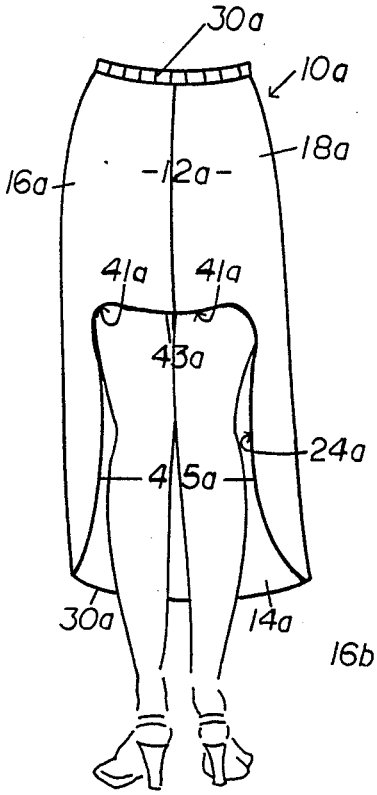
FIG. 7
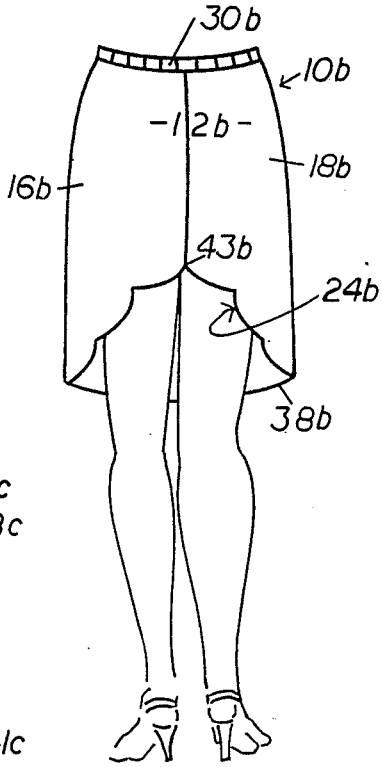
FIG. 8
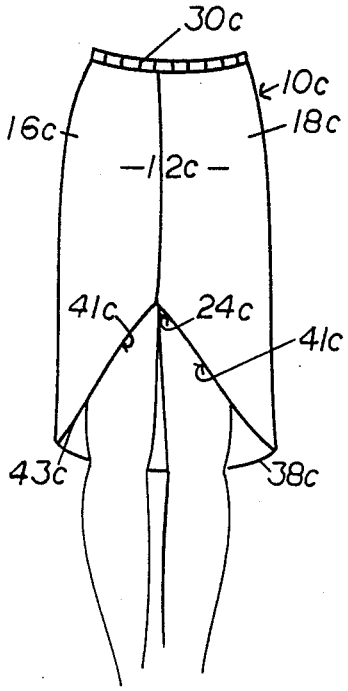
FIG. 9
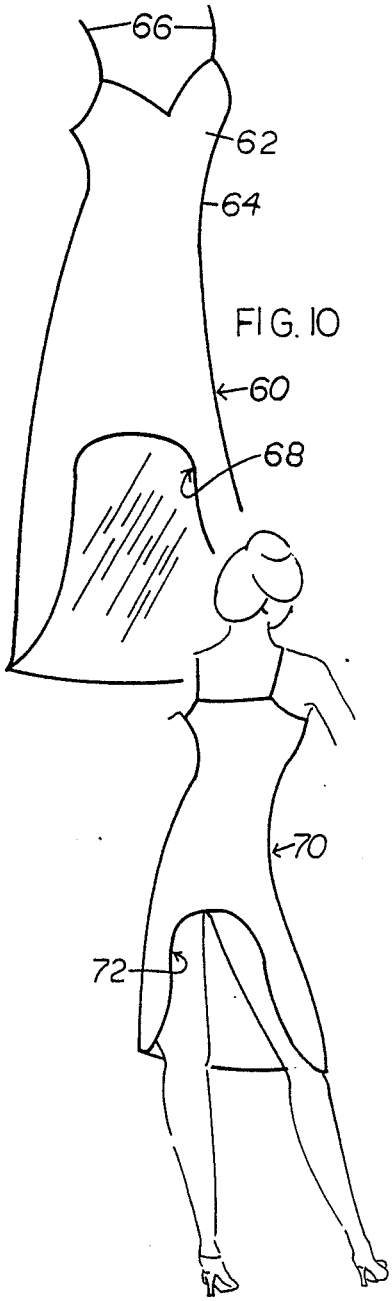
FIG. 10
FIG. 11

SLIP

BACKGROUND OF THE INVENTION

1. Field of the Invention

This invention relates to improvements in articles of lingerie, more particularly, to a slip capable of being used with dresses and skirts provided with slits at the lower edges thereof.

2. Description of the Invention

Many dresses and skirts have front, back or side slits extending upwardly from the lower edges thereof. These slits are provided for style, freedom of movement and other purposes. The slips which are generally selected for use with these dresses and skirts also have split front, back or side panels. However, these slips do not always precisely match up in location to the slits in the dresses and skirts so that portions of the slips often protrude from the slits. This mismatch is generally due to tapering, slits or other variations in the hemline design of the dresses and skirts no matter how high or wide the slits in the slips are. This mismatch is especially noticeable during walking.

To date, conventional slips that have been made to be worn with dresses and skirts of the type having the slits in the lower margins thereof are slips that have similar straight cut slits or with generally rounded lower corners. A slip of this type typically only stays lined up with the edges of a slit when the wearer is standing. As soon as the wearer walks, the slit in her skirt, whether it is in the back, the front or to one side, will shift from side to side and flap open to reveal the adjacent portion of the slip. Since the slip is not connected to the dress or skirt, it does not move with the dress or skirt and in most cases protrudes from the slit in the dress or skirt.

This showing of the slip is a problem which exasperates many women who are style conscious, who wish to wear clothing properly, and who consider it improper to allow a slip to show through the slits of a dress or skirt. Because of this problem, a need exists for an improved slip which eliminates the showing of the slip through the slit of a dress or skirt yet the slip still needs to be operable for its main purpose of blocking the light passing through the dress or skirt so as to avoid silhouetting the legs of the wearer. The present invention satisfies this need.

3. Description of Prior Art

Prior disclosures in this field of women's slips include the following U.S. Pat. Nos.: 3,066,308; 3,164,843; and 4,427,959.

SUMMARY OF THE INVENTION

The present invention is an improved slip to be worn as an undergarment beneath a dress or skirt of the type having a side, front or back slit, draped, scooped or other variations in the lower edge of a dress or skirt. To this end, the present invention includes a slip which can either be a half-slip or full slip. It is provided with an opening or recess in a panel of the slip, such as at the rear or front of the slip. The opening is of sufficient size to be larger than the slit in the dress or skirt with which the slip is used. The panel with the opening is opposite to a full panel, such as at the front or rear of the slip so that the full panel alone serves to block the light tending to pass through the dress or skirt and slip. Thus, the full panel will at all times, serve a main purpose of the slip, namely to effectively block the light so as to avoid silhouetting the legs of the wearer in an undesirable manner. With this one full panel, there is no need to have a conventional slip encompassing the legs of the wearer, and limiting the freedom of movement. However, the slip of the present invention still encompasses the hip area and lower torso, keeping the area smooth and protected from various dress materials.

The basic problem that the slip of the present invention resolves is that, with its large cutaway opening or recess, the slip does not protrude from a slit of an unevenly hemmed dress or skirt, no matter how high or wide the slit in the dress or skirt, even while the wearer is walking. The slip of the present invention leaves plenty of room for the slit of the dress or skirt to move back and forth across the legs in any position of the legs, such as while sitting, standing or walking.

Thus, the slip of the present invention can have a relatively large opening or recess in one panel, such as the rear panel, while the opposite panel, such as the front panel, can be used effectively to block the light which ordinarily tends to pass through the legs, so as to avoid silhouetting the legs in an undesirable manner. Moreover, other advantages of the present invention is that, because of a wider gripping elastic band, the slip of the present invention can be worn as a half-slip, with the recess or opening at the rear of the wearer, at the front of the wearer or at the side of the wearer without slippage from its placed position at the waist line. As a full slip, the recess or opening has only one position, namely at the front, back or at the side of the slip.

Another advantage of the slip of the present invention is that the opening of the slip allows freedom of movement from tighter slips and can also be worn under full-skirted dresses, with or without slitted or uneven hemlines.

A primary object of the present invention is to provide an improved slip having a number of panels with one of the panels having a relatively large recess or opening therein while the other panel is a full panel, whereby the slip is suitable for use with conventional dresses and skirts having slits at the front, back and side yet the full panel of the slip effectively blocks any light which tends to pass through the dress or skirt and the slip.

Another object of the invention is to provide an improved slip of the type described wherein the slip can either be a half-slip or full slip and the relatively large recess or opening prevents the slip from showing through the slit in the dress or skirt with which the slip is used without inhibiting the light blocking capability of the slip in a normal fashion.

Other objects of this invention will become apparent as the following specification progresses, reference being had to the accompanying drawings for an illustration of several embodiments of the slip of the present invention.

BRIEF DESCRIPTION OF THE DRAWINGS

FIG. 7 is a view similar to FIG. 4 but showing a slip of relatively longer length to be worn with a dress or skirt whose lower hemline is normally below the knees of the wearer and showing a different configuration for the opening;

FIG. 8 is a view similar to FIG. 7 but showing the slip having a length to accommodate a dress or skirt whose lower hemline is above the knees of the wearer and showing a different configuration for the opening;

FIG. 9 is a view similar to FIG. 4 but showing a different configuration for the recess or opening;

FIG. 10 is a front elevational view of a full slip having a recess or opening at the lower part of the front panel thereof;

FIG. 11 is a view similar to FIG. 10 but showing the recess or opening at the rear panel of the full slip.

DETAIELD DESCRIPTION OF THE DRAWINGS

Figure 1:
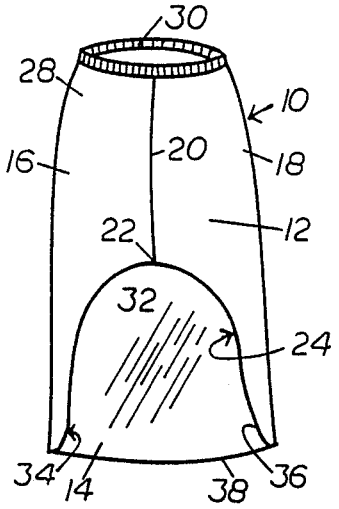
FIG. 1 is a perspective view of a halfslip forming a first embodiment of the present invention showing a recess or opening in one of the front panel and back panels of the slip.
Figure 2:
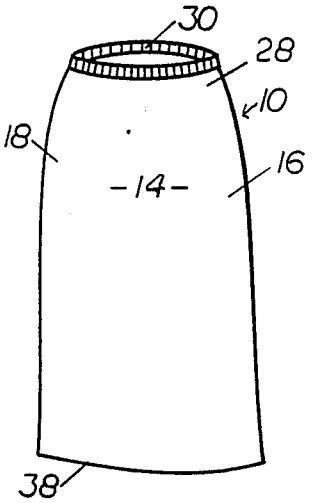
FIG. 2 is a view similar to FIG. 1 but showing the full panel of the slip.
Figure 3:
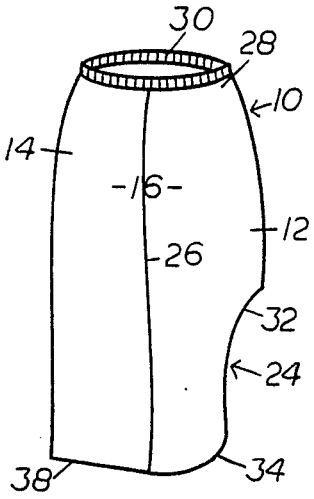
FIG. 3 is a perspective view of the slip of FIGS. 1 and 2 looking at the side thereof and showing a side edge defining a boundary of the recess or opening of FIG. 1.

A first embodiment of the article of lingerie of the present invention is shown in FIGS. 1–3 and comprises a half-slip 10 made of sheet fabric material, such as nylon, nylon tricot, silk, satin, polyester or any other conventional material. The slip 10 has a body with panels 12 and 14 which are interconnected or integral with each other at said side regions 16 and 18. Panel 12 can be comprised of two pieces joined by seam 20. Panels 12 and 14 can be made from a single sheet of material or from several interconnected sheets of material. Panel 12 can be the front panel or the back panel of slip 10. If panel 12 is the front panel, panel 14 is the rear panel, and vice versa. The panels 12 and 14 can be divided with seams, as desired. For purposes of illustration, panel 12 has a seam 20 which extends from the upper margin of the slip to a point 22 at the upper end of a recess or opening 24 to be described. In the alternative, the slip body at either or both side regions 14 and 16 may be provided with a seam, such as the seam 26 (FIG. 3) at the side region 16.

The upper margin of half-slip 10 is tapered inwardly to present a waist part 28 at the top of each of panels 12 and 14 to which an elastic band 30 is stitched or otherwise secured. The width of band 30 is in the range of ½′ to 1½′, more preferably ¾′to 1′. The purpose cf the relatively wide band 30 is to provide a more efficient hold down means for the upper end of the slip than is possible with the relatively narrow elastic band used on conventional half-slips in holding the slip in position without shifting at the waist during movement of the wearer.

Opening 24 is in the lower part of panel 12 and has an upper extremity at a location near the midpoint of panel 12. Opening 24 presents a bell-shaped recess which is bounded by concave upper edge 32 extending from the uppermost end of the opening 24 to convex lower edges 34 and 36 which are near the bottom edge 38 of slip 10. Portions 34 and 36, being convex as shown in FIG. 3, diverge relative to each other and merge smoothly with bottom edge 38.

The width of opening 24., that, is the distance between convex parts 34 and 36 is almost or substantially the full width of panel 12 so that the major portion of the side edges defining the side boundaries of panel 12 are the side panels 16 and 18. Thus, opening 24 essentially is defined by the removal of the lower part of panel 24. As shown in FIG. 1, lace trim can be applied along the convex and concave edges defining the boundaries of opening 24 for decorative purposes.

Panel 12 can be the front panel for use with a dress or skirt having a front slit, or panel 12 can be the rear panel of the slip if the slit in the dress or skirt is at the rear thereof. Thus, the slip 10 is reversible. In either case, the single panel 14 will be sufficient to prevent light from passing through the slip so as to avoid silhouetting of the legs of the wearer of the slip.

Figure 4:
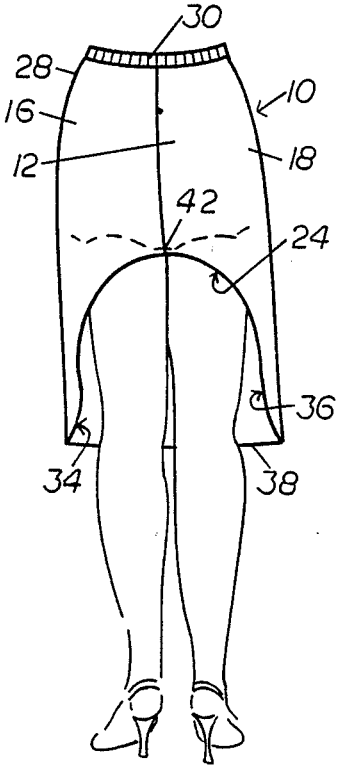
FIG. 4 is a rear elevational view of the slip on the body with the opening being at the rear panel and showing the full front panel.
Figure 5:
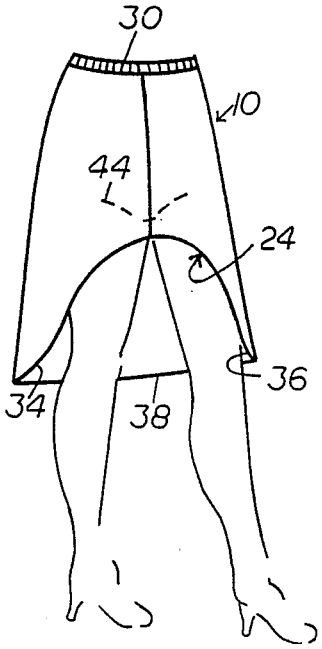
FIG. 5 is a view similar to FIG. 4 but showing the slip having the recess or opening at the front of the slip instead of at the back as shown in FIG. 4.

FIG. 4 shows the slip with opening 24 at the rear of the wearer for use with a dress or skirt with a rear slit. FIG. 5 shows panel 12 and opening 24 at the front of the wearer for use with a dress or skirt having a front slit. FIG. 4 further shows that the upper margin or upper extremity of opening 24 is in proximity to but below the panty line 42 of the wearer. Similarly, the front panty line 44 is shown above but in proximity to the upper margin of opening 24.

For most women, the distance from the lower edge of band 30 to the top extremity of opening 24 is in the range of 10 to 14 inches, more preferably 11 to 13 inches, and specifically 12½ inches on the average.

Figure 6:
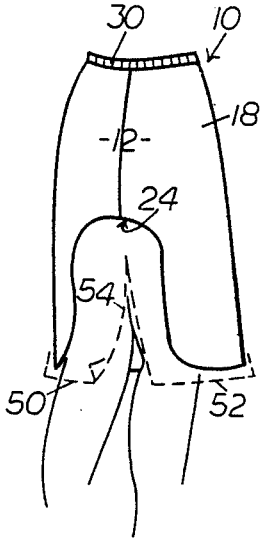
FIG. 6 is a perspective view of the slip, showing, in dashed lines, the lower edge or hem of a dress or skirt having an inverted V-shaped slit as is commonly known.
Figure 12:
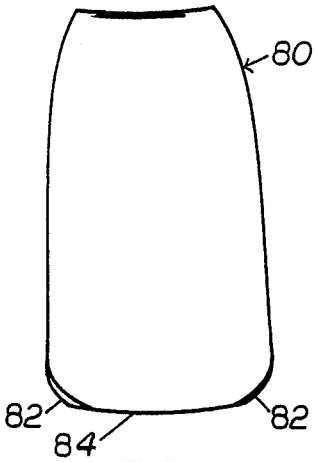
FIGS. 12–18 are elevational views of halfslips and full slips of conventional or prior art design, showing the slips with in the front or back panels of the slips.

FIG. 6 shows in dashed lines, a dress or skirt 50 having a bottom edge 52 and provided with an inverted V-shaped slit 54 at the rear of the dress or skirt. FIG. 6 therefore illustrates how the slip 10 is not seen in the slit 54, yet the front panel 14 of the slip 10 effectively blocks light tending to pass through the dress or skirt and the slip, which would otherwise silhouette the legs in an undesirable manner.

The recess or opening 24 allows plenty of room for dress hems with slits of the type shown in FIG. 6 to shift back and forth in walking without the slip showing. For a conventional dress with a slit, the only slips designed for this slit have a similar slit corresponding to the slit in the dress, and the slip never lines up the same in walking, and the slips always show or protrude from the skirt through the slip. The relatively wide opening 24 in slip 10 can be used with a back slit, front slit and a slit up the side with one leg slit for many dress designs including the front tulip wrap style or draped upward style. The single full panel 14 which does not have an opening 24, effectively blocks out all light and prevents the legs from being silhouetted. Thus, opening 24, whether it is used at the front or back of the slip allows adequate room for the slit of a dress to move back and forth across the legs as a woman walks without any of the slip showing through the slit. The slip can also be turned sideways for dresses that are slit up the sides.

The hemline on panel 14 is straight across, and is lace trimmed and slightly shorter than a dress length. Thus, it blocks all light and the legs are not silhouetted. The slip can be made in several lengths and colors and sizes. The seams can be at any location on the slip as shown in FIGS. 1 and 3.

FIG. 7 shows a slip **10*a* having a panel 12*a* and provided with a panel 14*a* opposite panel 12*a*. An opening or recess 24a is provided in the lower part of panel 12a and the slip is relatively long to accommodate a relatively long dress or skirt. As shown in FIG. 7, the bottom edge 38a of half-slip 10a is below the knees of the wearer. This is to be contrasted with a slip 10b (FIG. 8) where the bottom edge 38b** is above the knees of the wearer to accommodate a dress or skirt of relatively short length.

Opening 24a in slip 1Oa of FIG. 7 has a bell-shaped configuration which is slightly different in shape than that shown in FIG. 1 and FIGS. 4–6. The upper edge defining the upper extremity of opening 24a is in proximity to but slightly below the panty line 42a of slip 10a. The shape of opening 24a includes a pair of concave regions 41a on opposite sides of a convex region 43a, following which a pair of concave regions 45a are formed by the edge defining the sides of opening 24a. The bottom margins of opening 24a merge smoothly with the side portions of bottom edge 38a. The length of opening 24a from convex portion 43a to lower edge 38a is greater than the height or distance of the slip from the upper margin of the slip near band 30a to the upper margin 43a of the opening 24a.

Another configuration of the opening 24 is shown in FIG. 8 and includes an opening 24b formed by scalloped edges which have convex outer surfaces extending upwardly from the bottom edge 38b of the slip 10b and converge as the upper edge of the opening 24b is approached. There are three scalloped portions on each side of the center line of the seam 20b terminating at the upper pointed end 43b defining the upper extremity of opening 24b.

Another configuration of the opening is shown in FIG. 9 and includes an inverted V-shape wherein, in all cases, the side edges defining opening 24c diverge as a bottom edge 38c of slip 10c is approached.

In the embodiments of FIGS. 8 and 9, the width of the opening at the bottom edge is greater than the maximum height of the opening.

FIGS. 10 and 11 show how the teaching of the present invention can be embodied in a full slip. For instance, the full slip 60 of FIG. 10 has an upper portion 62 above the waist region 64 thereof and provided with shoulder straps 66. A bell-shaped opening 68 substantially similar in size and shape to opening 24 of FIGS. 1–6 is provided for the front panel slip 60. FIG. 11 shows a slip 70 having the opening 72 which is bell-shaped at the rear panel thereof.

Figure 16:
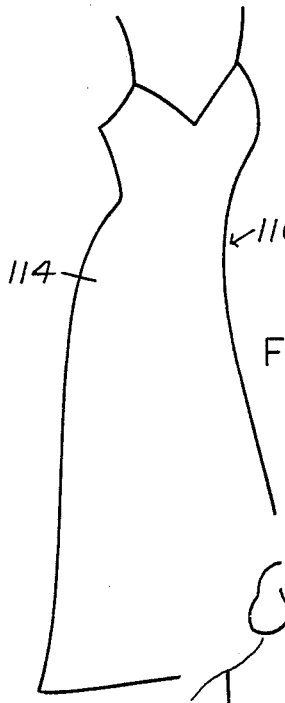
Figure 17:
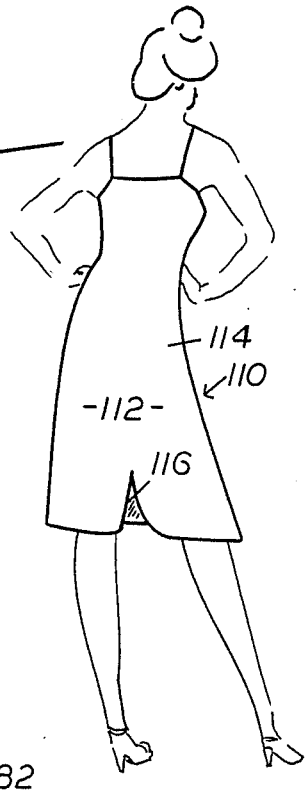

FIGS. 12–18 show conventional slips having different configured slits at the sides, at the front and at the back of the slips. FIG. 12–15 and 18 are half-slips and FIGS. 16 and 17 are full slips. Slip 80 of FIG. 12 has side slits 82 near the lower margin 84 thereof.

Figure 13:
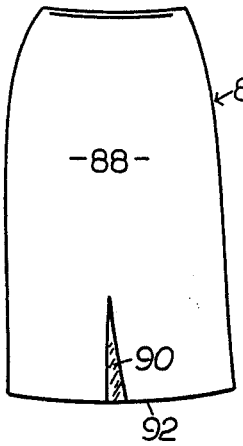

Slip 86 of FIG. 13 has a rear panel 88 provided with an inverted V-shaped slit 90 extending upwardly in panel 88 from the lower margin 92 thereof.

Figure 14:
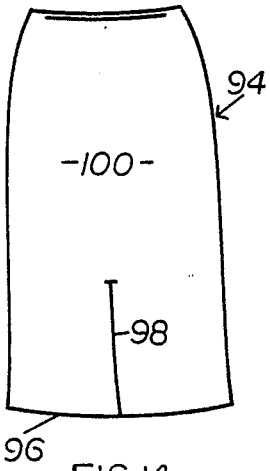
Figure 18:
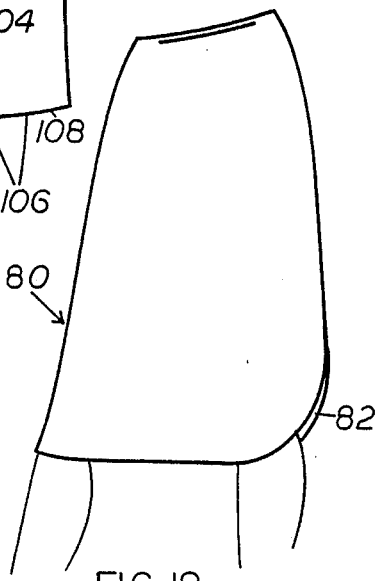

Half-slip 94 of FIG. 14 has a lower margin 96 and a closed slit 98 extending upwardly from bottom edge 96 in the back panel 100 of slip 94. Slip 102 of FIG. 15 has an inverted V-shaped slip 104 provided with convex lower edges 106 which merge smoothly with the bottom edge 108 of slip 102. FIG. 18 shows slip 80 (FIG. 12 in perspective) with the side slit 82 on one side of the slip showing.

Figure 15:
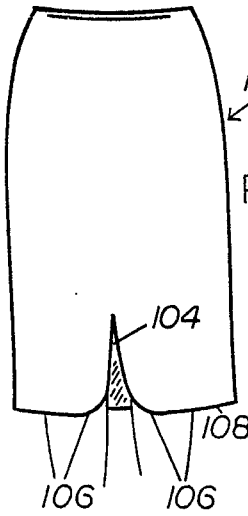

FIG. 17 shows a full slip 110 having a rear panel 112 below the waste region 114, panel 112 having an inverted V-shaped 116 of the same size and configuration of slit 104 of FIG. 15. FIG. 16 shows the front of slip 110.

It is clear that the conventional slips of FIGS. 12–18 cannot perform in the same manner as the slips of the present invention because, while the conventional slips have panels which prevent the legs from being silhouetted, the slips are still such that portions of the slips can be viewed through the slits of the dress or skirts with which they are used. This problem is avoided with the slip of the present invention, regardless of whether the slip is a half-slip or a full slip.

I claim:

1. An article of lingerie comprising:

a slip having a waist portion and pair of spaced panels extending downwardly form the waist portion, one of the panels having a midpoint, a bottom edge and an opening therein in the lower portion of said one panel, said opening extending downwardly from a location near the midpoint of said one panel and having a transverse dimension which progressively increases as the bottom edge of said one panel is approached, said one panel having an upper, substantially concave edge near the upper end of the opening, a pair of convex edges near the bottom edge of the one panel, and a pair of generally vertical edges interconnecting the ends of the concave edge with respective convex edges, whereby the opening is substantially bell-shaped.

2. An article of lingerie as set forth in claim 1, wherein the slip is a half-slip.

3. An article of lingerie as set forth in claim 1, wherein the slip is a full slip.

4. An article of lingerie as set forth in claim 1, wherein the distance from the waist portion to the upper extremity of the opening being in the range of 10 to 14 inches.

5. An article of lingerie comprising:

a slip having a waist portion, a bottom edge and a pair of spaced panels extending downwardly from the waist portion, one of the panels having an opening therein in the lower portion of one of the panels, said opening extending downwardly from a first location near the midpoint of said one panel to the lower edge of the slip, the opening having a transverse dimension which progressively increases as the lower edge of said one panel is approached, said opening having an inverted V-shaped configuration extending from the top of the opening at the bottom of the slip, the width of the opening at the bottom edge being greater than the maximum height of the opening.

6. An article of lingerie as set forth in claim 5, wherein the slip is a half-slip.

7. An article of lingerie as set forth in claim 5, wherein the slip is a full slip.

8. An article of lingerie for use by a wearer having a panty liner comprising:

a slip having a pair of panels, one of the panels having a bottom edge and an opening therein in the lower portion of said one panel, said opening extending upwardly from said bottom edge to a location near to and below the panty line of the wearer, said one panel having an upper, substantially concave edge near the upper end of the opening, a pair of convex edges near the bottom edge of the one panel, and a pair of generally vertical edges interconnecting the ends of the concave edge with respective convex edges, whereby the opening is substantially bell-shaped.

9. An article of lingerie as set forth in claim 8, wherein the slip is a half-slip.

10. An article of lingerie as set forth in claim 8 wherein the slip is a full slip.

11. An article of lingerie comprising:

a slip having a waist portion and pair of panels extending downwardly from the waist portion, one of the panels having a midpoint, a bottom edge and an opening therein in the lower portion of said one panel, said opening extending downwardly from a location near the midpoint of said one panel and having a transverse dimension which progressively increases as the bottom edge of said one panel is approached, said one panel having a number of side edges defining the boundaries of said opening, each side edge being convex and the side edges being in end-to-end relationship.

12. An article of lingerie comprising:

a slip having a waist portion, a bottom edge and a pair of panels extending downwardly from the waist portion, one of the panels having an opening therein in the lower portion of said one of the panels, said opening extending downwardly from a first location near the midpoint of said one panel to the lower edge of the slip, the distance from the waist portion to the top of the opening being in the range of 10 to 14 inches, said one panel having a number of side edges defining corresponding boundaries of said opening, each side edge being convex and the side edges being in end-to-end relationship.

13. An article of lingerie for use by a wearer having a panty line comprising:

a slip having a pair of panels, one of the panels having a bottom edge and an opening therein in the lower portion of said one panel, said opening extending upwardly from said bottom edge to a location near to and below the panty line of the wearer, said one panel having a number of side edges defining the boundaries of said opening, each side edge being convex and the side edges being in end-to-end relationship.

14. An article of lingerie for use by a wearer having a panty line comprising:

a slip having a pair of panels, one of the panels having a bottom edge and an opening therein in the lower portion of said one panel, said opening extending upwardly from said bottom edge to a location near to and below the panty line of the wearer, said one panel having an inverted V-shaped configuration extending from the top of the opening to the bottom edge of the slip, the width of the opening at the bottom edge being greater than the maximum height of the opening.

* * * * *